US009448041B2

(12) United States Patent
Gonda et al.

(10) Patent No.: US 9,448,041 B2
(45) Date of Patent: Sep. 20, 2016

(54) SYSTEMS, DEVICES, AND/OR METHODS FOR SHIELDING

(71) Applicants: Les Richard Gonda, Keswick, VA (US); Richard Kerry Elzey, Barboursville, VA (US); George Douglas Long, Charlottesville, VA (US)

(72) Inventors: Les Richard Gonda, Keswick, VA (US); Richard Kerry Elzey, Barboursville, VA (US); George Douglas Long, Charlottesville, VA (US)

( * ) Notice: Subject to any disclaimer, the term of this patent is extended or adjusted under 35 U.S.C. 154(b) by 0 days.

(21) Appl. No.: 15/004,969

(22) Filed: Jan. 24, 2016

(65) Prior Publication Data

US 2016/0216080 A1 Jul. 28, 2016

Related U.S. Application Data

(60) Provisional application No. 62/107,323, filed on Jan. 23, 2015.

(51) Int. Cl.
*F41H 5/14* (2006.01)

(52) U.S. Cl.
CPC ..... *F41H 5/14* (2013.01)

(58) Field of Classification Search
CPC ..... F41H 5/06; F41H 5/08; F41H 5/12; F41H 5/14; F41H 5/26; F41H 5/263; F41H 5/24
USPC ..... 89/36.07, 36.09
See application file for complete search history.

(56) References Cited

U.S. PATENT DOCUMENTS

| | | | | | |
|---|---|---|---|---|---|
| 1,281,400 | A * | 10/1918 | Larnell | F41H 5/14 | 109/49.5 |
| 1,304,541 | A * | 5/1919 | Clark | F41H 5/14 | 109/22 |
| 2,209,654 | A * | 7/1940 | Loeser, Jr. | F41H 5/08 | 109/49.5 |
| 2,370,596 | A * | 2/1945 | Wallace | F41H 5/08 | 109/49.5 |
| 3,232,370 | A * | 2/1966 | Jaffe | G10K 11/20 | 160/135 |
| 4,949,490 | A * | 8/1990 | Miller | G09F 15/0068 | 160/135 |
| 6,907,811 | B2 * | 6/2005 | White | F41H 5/14 | 109/49.5 |
| 7,849,781 | B2 | 12/2010 | White | | |
| 7,891,283 | B2 | 2/2011 | Kleniatis | | |
| 8,001,880 | B2 | 8/2011 | White | | |

(Continued)

*Primary Examiner* — Bret Hayes
*Assistant Examiner* — Derrick Morgan
(74) *Attorney, Agent, or Firm* — Dale Jensen, PLC; Dale Jensen

(57) ABSTRACT

Certain exemplary embodiments provide a barrier comprising a shield unit that comprises of a bullet resistant material, such as metal, plastic, ceramic or a composite material. The shield unit can comprise one or more windows of a substantially transparent comprising a bullet resistant material, such as a bullet resistant plastic or glass. The shield unit can comprise an armaments port through which firearms can be shot. The shield unit can comprise two sets of wheels, one for transporting the shield unit with a motor vehicle to an active site, the second of which is used to move the shield unit after the shield unit is deployed at the active site.

7 Claims, 5 Drawing Sheets

(56) References Cited

U.S. PATENT DOCUMENTS

| | | | | |
|---|---|---|---|---|
| 8,015,910 | B1 * | 9/2011 | Fuqua | F41H 5/14 89/36.01 |
| 8,291,657 | B2 | 10/2012 | White | |
| 8,371,207 | B2 | 2/2013 | White | |
| 8,397,618 | B2 * | 3/2013 | White | F41H 5/26 52/741.3 |
| 8,590,439 | B2 | 11/2013 | White | |
| 8,656,821 | B2 | 2/2014 | White | |
| 8,726,780 | B2 * | 5/2014 | White | F41H 5/24 89/36.04 |
| 8,726,782 | B2 | 5/2014 | White | |
| 9,347,748 | B1 * | 5/2016 | Crisp | F41H 5/08 |
| 2002/0092416 | A1 * | 7/2002 | Cohen | F41H 5/08 89/36.05 |
| 2003/0167911 | A1 * | 9/2003 | White | F41H 5/14 89/36.07 |
| 2009/0067923 | A1 * | 3/2009 | Whitford | F41H 11/08 404/6 |
| 2012/0168702 | A1 * | 7/2012 | Fromm | E01F 13/12 256/13.1 |
| 2012/0186435 | A1 * | 7/2012 | Garcia | F41H 5/08 89/36.07 |
| 2014/0202324 | A1 * | 7/2014 | Robbins | F41H 7/048 89/36.08 |

* cited by examiner

SYSTEMS, DEVICES, AND/OR METHODS FOR SHIELDING

CROSS-REFERENCES TO RELATED APPLICATIONS

This application claims priority to, and incorporates by reference herein in its entirety, U.S. Provisional Patent Application Ser. No. 62/107,323, filed Jan. 23, 2015.

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Certain exemplary embodiments provide a barrier comprising a shield unit that comprises a bullet resistant material, such as metal, plastic, ceramic or a composite material. The shield unit can comprise one or more windows of a substantially transparent comprising a bullet resistant material, such as a bullet resistant plastic or glass. The shield unit can comprise a shooting port through which firearms can be shot. The shield unit can comprise two sets of wheels, one for transporting the shield unit with a motor vehicle to an active site, the second of which is used to move the shield unit after the shield unit is deployed at the active site.

The uniqueness of this mobile transforming shield (MTS) is the design, with strategically placed pivot points that balance the weight in a manner that one adult can manipulate the shield that may weigh in excess of 1000 pounds. A single individual can, hook it to a towing vehicle, drive to a delivery point, unhook, stand it up and roll it into position.

Figure 1:
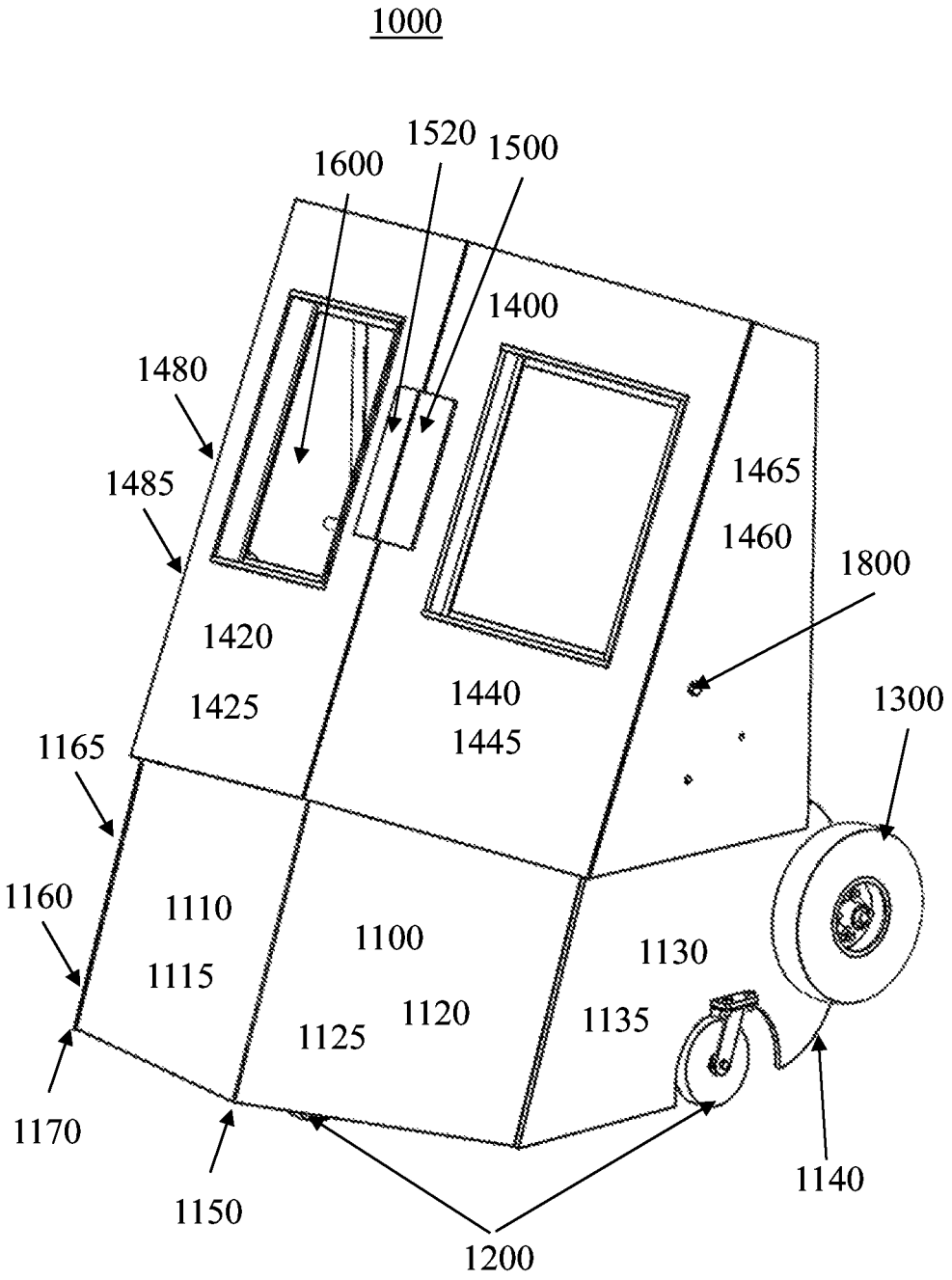
FIG. 1 is a perspective view of an exemplary embodiment of a system 1000.

FIG. 1 is a perspective view of an exemplary embodiment of a system 1000, which can comprise a base section 1100. Base section 1100 can comprise a first base front panel 1110, a second base front panel 1120, a first base side panel 1160 (substantially hidden in the illustrated view), and a second base side panel 1130, which are constructed to partially surround one or more users standing behind system 1000. System 1000 can comprise a pair of positioning wheels 1200, which are constructed to allow one or more users to move system 1000 while being ballistically shielded from armaments that may be discharged toward system 1000 from a frontal direction.

Figure 4:
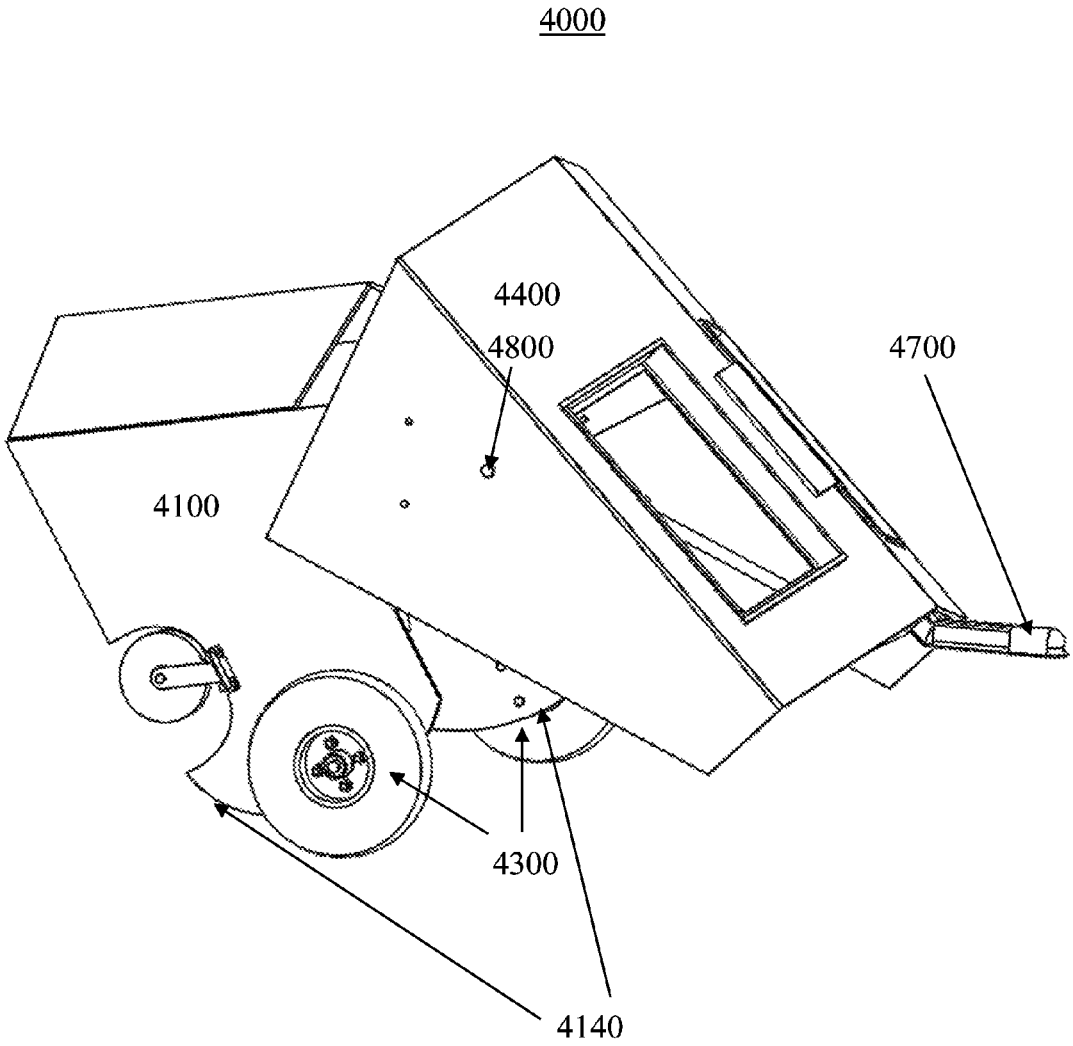
FIG. 4 is a perspective view of an exemplary embodiment of a system 4000 in a towable configuration.

First base side panel 1160 and/or second base side panel 1130 can define a rocker section 1140, which is constructed to allow one or more users to rotate system 1000 into and/or out of a towable configuration (as illustrated in FIG. 4). One or more users can grasp a bar or handle comprised by system 1000 and apply downward force to cause the weight of system 1000 to rest on rocker section 1140. The curved shape of rocker section 1140 allows system 1000 to be rolled to the towable configuration, where transportation wheels 1300 rests on the earth and system 1000 can be towed by a motor vehicle. When in a towable configuration, transportation wheels 1300 can be used to move system 1000 utilizing a motor vehicle with a trailer hitch. System 1000 can comprise and/or be operatively coupled to a coupling, which is constructed to be coupled to the trailer hitch.

Figure 3:
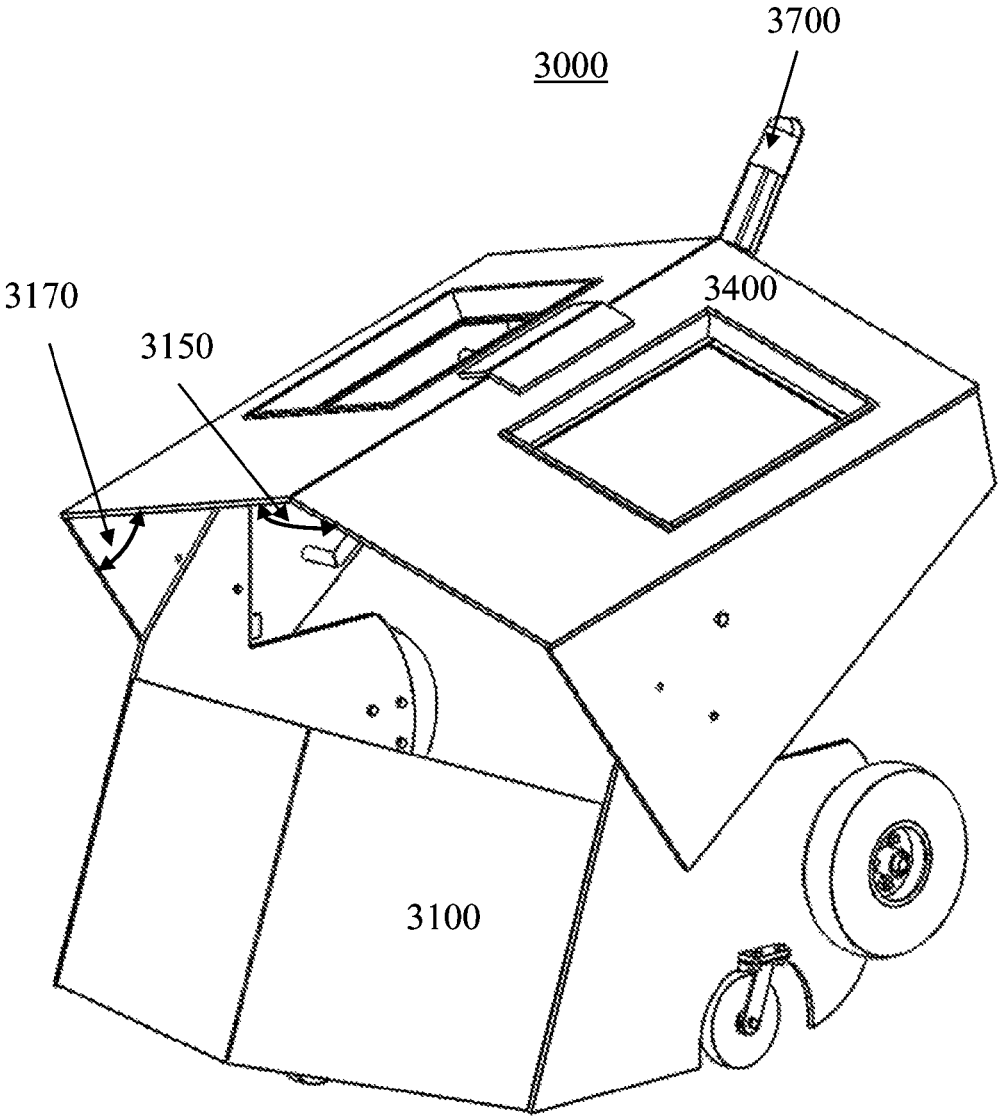
FIG. 3 is a perspective view of an exemplary embodiment of a system 3000 in a partially folded configuration.

System 1000 can comprise a set of apertures 1800. Set of apertures 1800 can be constructed to allow the apex section 1400 of system 1000 to be rotated and fixed relative to base section 1100 of system 1000 as illustrated in FIG. 3; thereby repositioning the center of mass of system 1000 toward the transportation wheels 1300. For example, a shaft and pin set can be used to lock and substantially fix apex section 1400 of system 1000 relative to base section 1100 in the orientation illustrated in FIG. 1. Similarly, the shaft and pin set can be used to lock and substantially fix apex section 1400 of system 1000 relative to base section 1100 in the configuration illustrated in FIG. 3 and FIG. 4.

Apex section 1400 can comprise a first apex front panel 1420, a second apex front panel 1440, a first apex side panel 1480 (substantially hidden in this view) and second apex side panel 1460, which are constructed to partially surround one or more users standing behind system 1000.

System 1000 can define a shooting port 1500, which can be used by one or more users to fire ammunition from behind system 1000. System 1000 can comprise a slidably openable port cover 1520. When slidably closed, slidably openable port cover 1520 can act as a portion of a ballistic shield to armaments discharged in a direction of system 1000. As desired by the one or more users, slidably openable port cover 1520 can be slidably opened to allow the one or more users to fire ammunition through shooting port 1500 at one or more targets in front of system 1000.

System 1000 can comprise one or more windows 1600. Windows 1600 can be substantially transparent to a human and can be fabricated and/or constructed from a bullet resistant material, such as a bullet resistant plastic or glass. The one or more users of system 1000 can view a scene in front of system 1000 and can make decisions based upon observations about where and how to position system 1000 advantageously to accomplish strategic objectives.

Base section 1100 can comprise:

- a first base front panel 1110 defining a first plane 1115 (i.e., first plane 1115 is defined by a front face of first base front panel 1110);
- a second base front panel 1120 defining a second plane 1125 (i.e., second plane 1125 is defined by a front face of second base front panel 1120), wherein first plane 1115 intersects second plane 1125 at a first obtuse angle 1150 (see also, angle 3150 of FIG. 3, which provides another view of the first obtuse angle of intersection);
- a first base side panel 1160 defining a third plane 1165 (i.e., third plane 1165 is defined by a front face of first base side panel 1160);
- a second base side panel 1130 defining a fourth plane 1135 (i.e., fourth plane 1135 is defined by a front face of second base side panel 1130), wherein third plane 1165 is substantially parallel to fourth plane 1135, wherein first plane 1115 intersects third plane 1165 at a second obtuse angle 1170 (see also, angle 3170 of FIG. 3, which provides another view of the second obtuse angle of intersection);
- a pair of transportation wheels 1300; and/or
- a pair of positioning wheels 1200, pair of positioning wheels 1200 can be constructed to allow the system to be moved via humans from behind the system.

Apex section can comprise:

a first apex front panel 1420 defining a fifth plane 1425 (i.e., fifth plane 1425 is defined by a front face of first apex front panel 1420);

a second apex front panel 1440 defining a sixth plane 1445 (i.e., sixth plane 1445 is defined by a front face of second apex front panel 1440), fifth plane 1425 intersecting sixth plane 1445 at substantially first obtuse angle 1150;

a first apex side panel 1480 defining a seventh plane 1485 (i.e., seventh plane 1485 is defined by a front face of first apex side panel 1480);

a second apex side panel 1460 defining an eighth plane 1465 (i.e., eighth plane 1465 is defined by a front face of second apex side panel 1460), the seventh plane substantially parallel to the eighth plane, the fifth plane intersecting seventh plane at substantially second obtuse angle 1170; and a receiver (see receiver 3700 of FIG. 3 and receiver 4700 of FIG. 4) coupled to at least one of first apex front panel 1420 and second apex front panel 1440, the receiver constructed to be coupled to a vehicle trailer hitch to transport the system via rotation of the transportation wheels;

Apex section 1400 is constructed to rotate on hinges relative to base section 1100 to reduce a height of system 1000 when moved via transportation wheels 1300. When placed in a shield configuration, system 1000 can function as a ballistic shield. Rotation via hinges results in system 1000 changing from a shield configuration to a towable configuration.

System 1000 can comprise a lock, which is constructed to be positioned by a human to restrain rotation of the apex section relative to the base section to hold system 1000 in either a shield configuration or a towable configuration.

System 1000 can comprise window 1600 coupled to at least one of first apex front panel 1420 and second apex front panel 1440 (the illustrated embodiment comprises a window in each of first apex front panel 1420 and second apex front panel 1440). Window 1600 can be substantially transparent to a human. Window 1600 can be constructed from a substantially bullet resistant material.

System 1000 can comprise slidably openable port cover 1520, which can be coupled to at least one of first apex front panel 1420 and second apex front panel 1440. When slidably closed, slidably openable port cover 1520 is constructed to act as a ballistic shield to armaments discharged in a direction of system 1000. When slidably opened, slidably openable port cover 1520 is constructed to expose shooting port 1500, which is defined by at least one of first apex front panel 1420 and second apex front panel 1440. Shooting port 1500 is constructed to allow the one or more humans to fire ammunition through shooting port 1500 at one or more targets in front of system 1000.

Each of first base side panel 1160 and second base side panel 1130 can define a curved shape rocker section that allows 1140 the system to be rolled from a shield configuration to the towable configuration. Apex section 1400 can be rotated relative to 1100 base section via hinge pins as illustrated in FIG. 3 and FIG. 4. System 1000 can define set of apertures 1800. Set of apertures 1800 can be constructed to allow apex section 1400 to be rotated and fixed relative to base section 1100 into a towable configuration.

Figure 2:
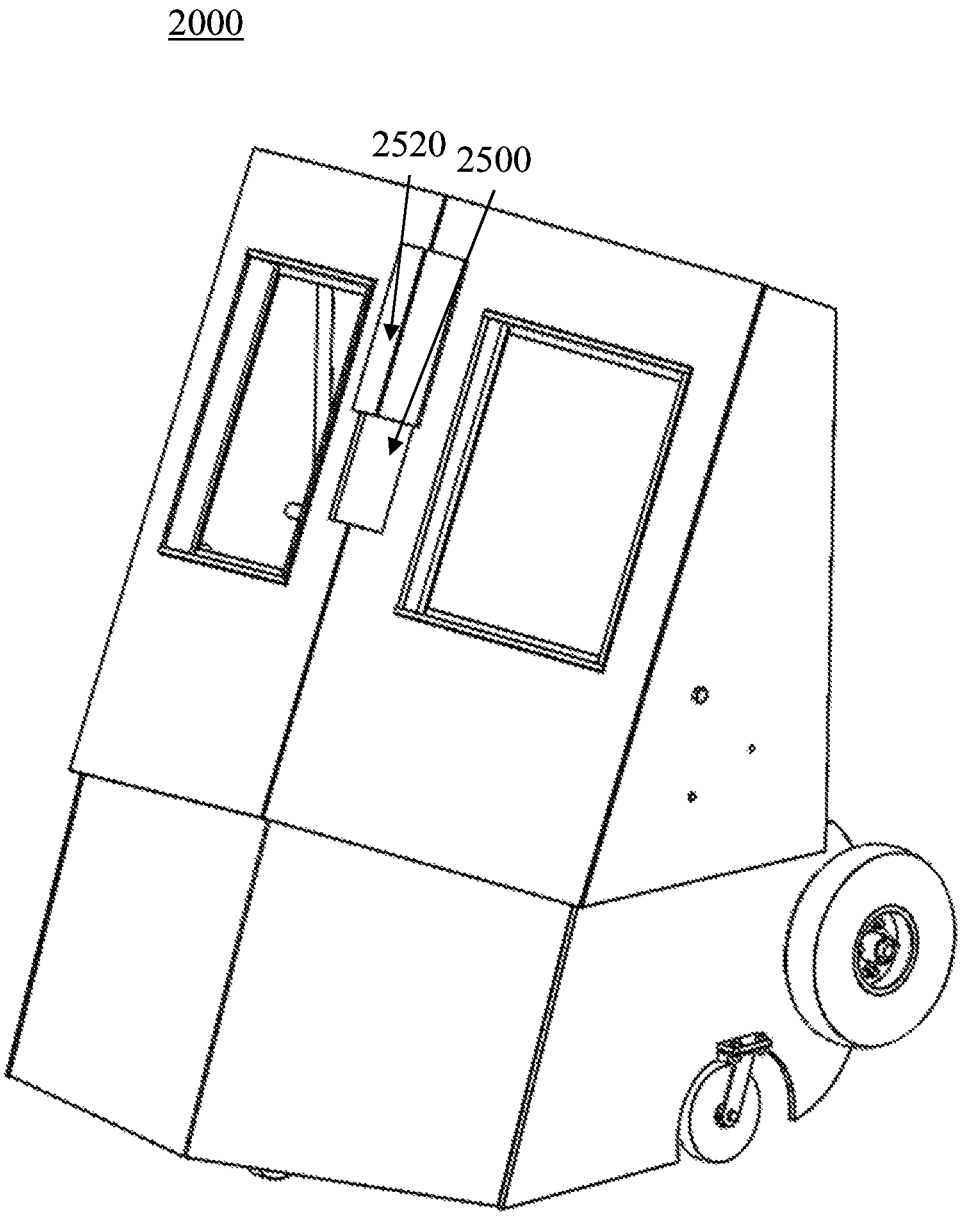
FIG. 2 is a perspective view of an exemplary embodiment of a system 2000.

FIG. 2 is a perspective view of an exemplary embodiment of a system 2000 with an open shooting port 2500. As illustrated, slidably openable port cover 2520 can be slidably opened in order to provide a port for discharging armaments at a target in front of system 2000.

FIG. 3 is a perspective view of an exemplary embodiment of a system 3000 in a partially folded configuration. Apex section 3400 of system 3000 can be folded relative to base section 3100. One or more users can apply downward force to apex section 3400 via one or more provided handles or grippable sections of system 3000. The downward force can cause apex section 3400 to move relative to base section 3100 via one or more hinges or pivot points comprised by system 3000. System 3000 also illustrates a receiver 3700 operatively coupled to system 3000 and constructed to be coupled to a trailer hitch on a towing motor vehicle. System 3000 can be placed in the illustrated folded configuration by removing one or more fasteners, such as shaft and pin fasteners, which would otherwise fix a position of apex section 3400 relative to base section 3100.

FIG. 4 is a perspective view of an exemplary embodiment of a system 4000 in a towable configuration. System 4000 comprises a base section 4100 and an apex section 4400, which can be folded and rotated from the configuration illustrated in FIG. 1 to the towable configuration illustrated in FIG. 4. Set of apertures 4800 can be constructed to allow a position of apex section 4400 of system 4000 to be fixed relative to base section 4100 of system 4000. For example, a shaft and pin set can be used to lock and substantially fix apex section 4400 of system 4000 relative to base section 4100 in the towable configuration illustrated in FIG. 4.

One or more users can grasp a bar or handle comprised by system 4000 and apply a downward force to cause the weight of system 4000 to rest on rocker section 4140. The curved shape of rocker section 4140 allows system 4000 to be rolled into and/or out of the towable configuration, where trailer wheel set 4300 rests on the earth and system 4000 can be towed by a motor vehicle. When in a towable configuration, trailer wheel set 4300 can be used to move system 4000 utilizing a motor vehicle with a trailer hitch. System 4000 can comprise and/or be operatively coupled to receiver 4700, which can be constructed to be coupled to the trailer hitch.

Figure 5:
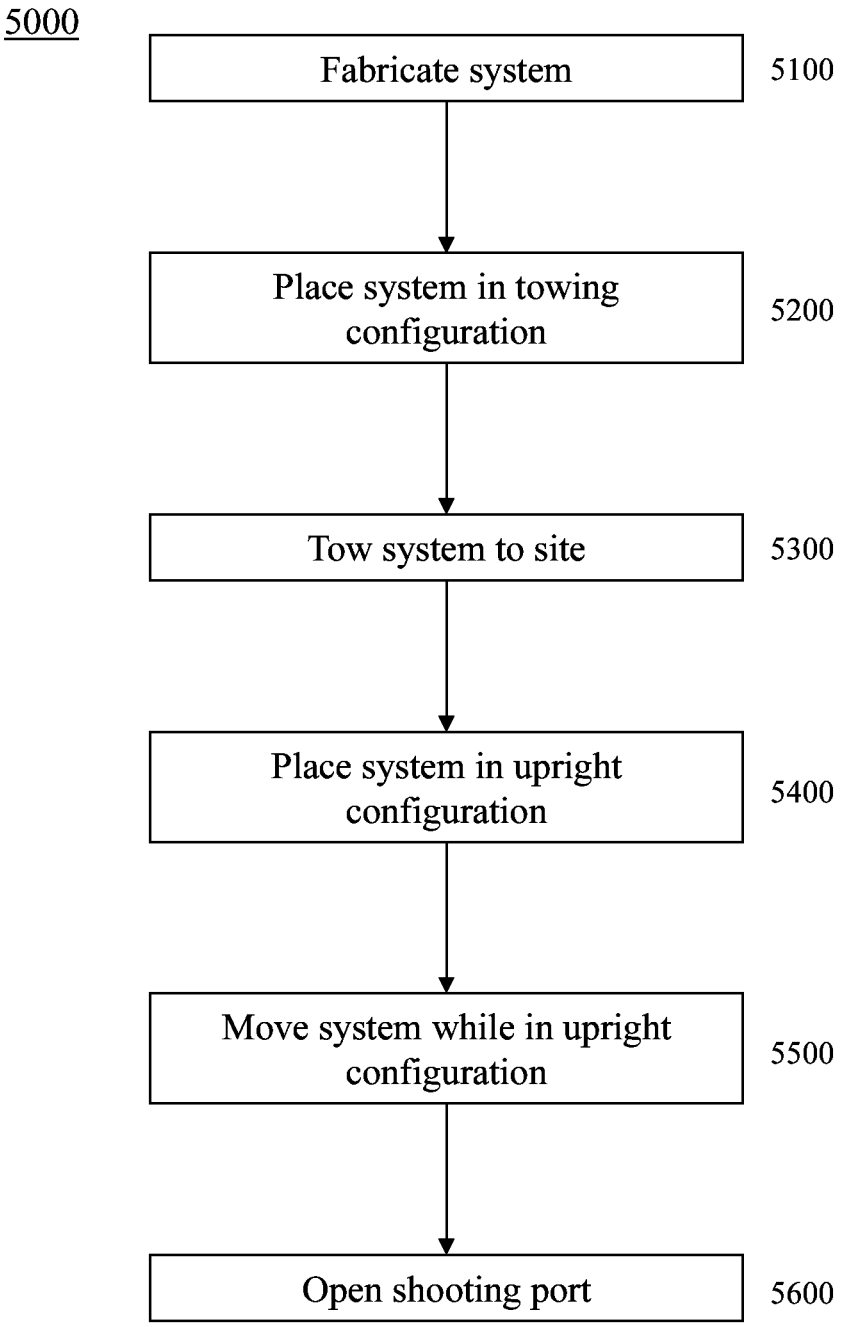
FIG. 5 is a flowchart of an exemplary embodiment of a method 5000.

FIG. 5 is a flowchart of an exemplary embodiment of a method 5000. At activity 5100, a system can be fabricated. The system can be a shield system illustrated in FIG. 1 and can be constructed to shield one or more users from armaments (e.g., bullets) fired towards the system. At activity 5200, the system can be placed in a towable configuration, such as illustrated in FIG. 4, and/or can be operatively coupled to a motor vehicle. At activity 5300, the motor vehicle can be used to tow, via a trailer wheel set, the system to an active site where users desire a shield from armament discharge. Upon arrival at the active site, the system can be uncoupled from the motor vehicle.

At activity 5400, the system can be placed in an upright configuration, such as illustrated in FIG. 1. At activity 5500, the system can be moved, via a roller wheel set, by one or more users shielded by the system to a position desired by the one or more users. At activity 5600, the one or more users can open a shooting port of the system to fire armaments while being substantially shielded by the system.

DEFINITIONS

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.

activity—an action, act, step, and/or process or section thereof.

allow—to permit.

and/or—either in conjunction with or in alternative to.

apex—an uppermost section in operative embodiments.

aperture—an opening.

apparatus—an appliance or device constructed to a particular purpose.

armament—a weapon.

associate—to join, connect together, and/or relate.

ballistic shield—a barrier specifically constructed to substantially defeat handgun, long gun, shotgun projectile threats, stabbing or cutting-type weaponry, and/or hand-thrown or launched projectiles such as rocks and arrows.

base—a lower section of operative embodiments.

behind—positioned on a side of a system such that a barrier is between a potential danger at a scene and a human.

bullet resistant material—a substance that does not allow passage of a projectile from a gun.

can—is capable of, in at least some embodiments.

comprising—including but not limited to.

constructed to—built for a specific use or situation.

couple—to join, connect, and/or link together.

curved shape—having a contour that defines an arc.

define—to establish the outline, form, or structure of.

device—a machine, manufacture, and/or collection thereof.

direction—a line along which something moves.

discharge—to fire a weapon.

expose—to uncover.

front—a side of a system facing a direction of danger at a scene.

height—a distance from a top of something to a bottom of something.

hinge—a jointed apparatus on which a swinging part turns.

pin—a piece of solid material used for fastening or supporting one thing from another.

humans—*homo sapiens*.

intersect—to cross along a line.

lock—an apparatus constructed to secure something in a fixed position.

may—is allowed and/or permitted to, in at least some embodiments.

method—a process, procedure, and/or collection of related activities for accomplishing something.

move—to reposition from one location to another.

obtuse angle—an angle greater than approximately ninety degrees but less than approximately one hundred and eighty degrees.

open—lacking a barrier.

panel—a substantially flat piece of something.

parallel—substantially equidistant at all points.

plane—a substantially flat surface.

plurality—the state of being plural and/or more than one.

port cover—a piece of material that is placed over an opening.

position—to place.

positioning wheels—substantially circular apparati that turn on an axis for the purpose of movement of a system via human energy rolling over a relatively short distance (i.e., less than approximately one mile).

predetermined—established in advance.

provide—to furnish, supply, give, and/or make available.

push—to press against with force in order to drive or impel.

receive—to get as a signal, take, acquire, and/or obtain.

receiver—an apparatus constructed to couple to a trailer hitch.

reduce—to diminish.

repeatedly—again and again; repetitively.

restrain—to limit motion of.

rocker section—a section of a system on which a section of a weight of a system rests when the system is rotated.

roll—to move via rotation.

rotate—to turn about an axis.

section—a distinct section of something.

shield configuration—a state of a system when the system is locked at full height and a pair of positioning wheels comprised by the system are in contact with the ground.

shooting port—an opening through which a weapon can be fired.

slide—to move smoothly along a surface.

substantially—to a great extent or degree.

system—a collection of mechanisms, devices, machines, articles of manufacture, processes, data, and/or instructions, the collection constructed to perform one or more specific functions.

target—a mark that is shot at.

towable configuration—a positioning of a system that allows the system to be moved via a vehicle coupled to the system via a trailer hitch, wherein a pair of transportation wheels comprised by the system are in contact with the ground.

trailer hitch—an apparatus coupleable to a vehicle, the apparatus comprising a ball that is constructed to engage with a receiver to tow something with the vehicle.

transparent—having a property of transmitting light without appreciable scattering so that bodies lying beyond are seen relatively clearly by a human.

transportation wheels—substantially circular apparati that turn on an axis for the purpose of movement of a system coupled to a vehicle via rolling over a potentially long distance (i.e., potentially greater than approximately one mile).

vehicle—a means of conveyance that moves on wheels.

via—by way of and/or utilizing.

window—a defined opening in something in which a light transmitting material is placed.

Note

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any section (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;

no characteristic, function, activity, or element is "essential";

any elements can be integrated, segregated, and/or duplicated;

any activity can be repeated, any activity can be performed by multiple entities, and/or any activity can be performed in multiple jurisdictions; and any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope. No claim of this application is intended to invoke paragraph six of 35 USC 112 unless the precise phrase "means for" is followed by a gerund.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every section (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

What is claimed is:

1. A system comprising:

a base section, said base section comprising:

a first base front panel defining a first plane;

a second base front panel defining a second plane, said first plane intersecting said second plane at a first obtuse angle;

a first base side panel defining a third plane;

a second base side panel defining a fourth plane, said third plane substantially parallel to said fourth plane, said first plane intersecting third plane at a second obtuse angle;

a pair of transportation wheels; and a pair of positioning wheels, said pair of positioning wheels constructed to allow said system to be moved via humans pushing from behind said system; and an apex section, said apex section comprising:

a first apex front panel defining a fifth plane;

a second apex front panel defining a sixth plane, said fifth plane intersecting said sixth plane at said first obtuse angle;

a first apex side panel defining a seventh plane;

a second apex side panel defining a eighth plane, said seventh plane substantially parallel to said eighth plane, said fifth plane intersecting seventh plane at said second obtuse angle; and a receiver coupled to at least one of said first apex front panel and said second apex front panel, said receiver constructed to be coupled to a vehicle trailer hitch to move said system via rotation of said transportation wheels;

wherein:

said apex section is constructed to rotate on hinges relative to said base section to reduce a height of said system when moved via said transportation wheels; and said system functions as a ballistic shield.

2. The system of claim 1, further comprising:

a lock, said lock constructed to be positioned by a human to restrain rotation of said apex section relative to said base section.

3. The system of claim 1, further comprising:

a window coupled to at least one of said first apex front panel and said second apex front panel, said window substantially transparent to a human, said window constructed from a substantially bullet resistant material.

4. The system of claim 1, further comprising:

a slidably openable port cover, said slidably openable port cover coupled to at least one of said first apex front panel and said second apex front panel, when slidably closed, said slidably openable port cover constructed to act as a part of said ballistic shield to armaments discharged in a direction of said system, when slidably opened, said slidably openable port cover constructed to expose a shooting port defined by at least one of said first apex front panel and said second apex front panel, said shooting port constructed to allow the one or more humans to fire an armament through said shooting port at one or more targets in front of said system.

5. The system of claim 1, wherein:

each of said first base side panel and said second base side panel defines a curved shape rocker section that allows said system to be rolled to a towable configuration.

6. The system of claim 1, wherein:

said apex section is rotated relative to said base section via hinge pins.

7. The system of claim 1, wherein:

said system defines a set of apertures, said set of apertures constructed to allow said apex section to be rotated and fixed relative to said base section into a towable configuration.

* * * * *